United States Patent [19]

Komatsu

[11] 3,964,502

[45] June 22, 1976

[54] COMBINED HAIR STYLER AND DETANGLER

[75] Inventor: Ikuo I. Komatsu, Winona, Minn.

[73] Assignee: Sunbeam Corporation, Chicago, Ill.

[22] Filed: July 14, 1975

[21] Appl. No.: 595,459

[52] U.S. Cl. ..... 132/11 A; 132/9

[51] Int. Cl.[2] ..... A45D 24/00

[58] Field of Search ..... 132/11 A, 11 R, 9, 142, 132/139; 34/98, 96, 91; 74/574; 128/32

[56] References Cited

UNITED STATES PATENTS

| | | | |
|---|---|---|---|
| 1,357,031 | 10/1920 | Daugherty | 132/11 A |
| 3,204,469 | 9/1965 | Spillers | 132/11 R |
| 3,272,023 | 9/1966 | Ferguson et al. | 74/55 |

*Primary Examiner*—G.E. McNeill

*Attorney, Agent, or Firm*—George R. Clark; Neil M. Rose; Clifford A. Dean

[57] ABSTRACT

A hand held hair styler is provided with a fan blower and a hair detangling feature comprising two counter-reciprocating comb members positioned immediately adjacent an air discharge slot of the hair styler. The fan blower and the detangling combs are driven by two separate and independent motors which assure continued high volume air flow in spite of excessive loads being applied to the counter reciprocating combs. The supporting and driving means for the combs are positioned at either end of the elongated air discharge slot of the hair styler and are rockable about vertically disposed axes. A manually operable slide member is provided for ejecting the combs from their supporting means.

10 Claims, 7 Drawing Figures

4.
4.
30
50
86
49
51
58
59
38
37
32
31
41
43
52
61
62
63
65

5.
6.
30
50
86
33
31
32
37
38
39
40
41
43
43a
44
45
46
51
52
53
54
57
58
59
61
62
65
66
67
69
70
71
73

COMBINED HAIR STYLER AND DETANGLER

BACKGROUND OF THE INVENTION

As far as is known, only a single attempt has been made to combine the very popular hand held hair styler of the type having a fan blower with the more recently introduced hair detangler of the type having a pair of counter reciprocating combs positioned close together and reciprocated at a relatively high speed in order to untangle the hair through which the comb teeth are moved. The single known combination appliance of this type is disclosed in U.S. Pat. No. 3,853,133, dated Dec. 10, 1974, which issued to the same assignee to whom this application is also assigned.

The combination hair styling appliance disclosed in U.S. Pat. No. 3,853,133 is characterized by a double yoke arrangement at the driving end of the combs including a pair of rocking members which are rockable about a horizontal axis. The subject application is directed to an improvement over the combination hair styling and detangling appliance of U.S. Pat. No. 3,853,133, which improvement is characterized by a less complicated, sturdier, more efficient, and more economical comb driving arrangement and by improved means for ejecting the combs from the appliance. The improved comb driving means is characterized by a single yoke member and a single comb supporting member which is rockable about a vertical axis at the driving end of the combs.

BRIEF SUMMARY OF THE INVENTION

The invention comprises a hand-held hair styler which has combined with it a pair of counter reciprocating hair detangling combs which are positioned immediately in front of an air discharge opening in the hair styler. The hair styler portion of the appliance includes a small permanent magnet motor which is drivingly connected to an elongated, tangential fan rotor or blower which discharges air through a discharge slot in the housing. Positioned within the handle of the appliance is a second permanent magnet motor drivingly connected by a single yoke member to the counter reciprocating combs which are detachably received on supporting and driving means which are rockable about vertical axes at either end of the air discharge passageway of the hair styler. A manually slidable comb ejector is disposed adjacent the air discharge slot to facilitate ejecting the combs from their supporting means.

It is an object of the present invention to provide an improved combined hand-held hair styling and untangling appliance.

It is a further object of the present invention to provide an improved hand-held hair styling and untangling appliance having two separate and independent motors which drive the fan and the reciprocating means for the hair untangling combs.

It is another object of the present invention to provide an improved hand-held hair styler having hair untangling combs mounted coextensive with the air discharge opening in the housing and detachably connected to supporting and driving means which are rockable about verticle axes and are positioned at either end of the air discharge opening of the hair styler.

It is still another object of the present invention to provide an improved combined hand-held hair styler and hair untangling appliance having a manually slidable comb ejector to facilitate ejection of the combs from their supporting means.

Further objects and advantages of the present invention will become apparent as the following description proceeds and the features of novelty which characterize the invention will be pointed out with more particularity in the claims annexed to and forming a part of this specification.

Figure 1:
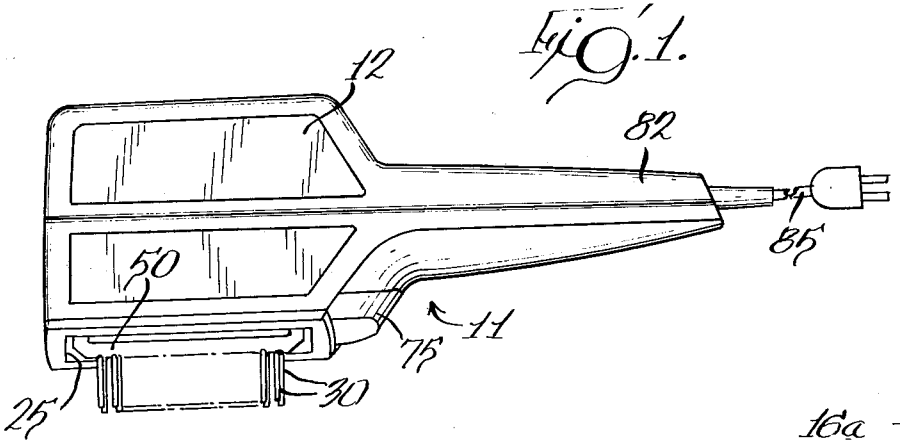
FIG. 1 is a perspective view of a combined hand-held styler and hair detangling comb embodying the invention.

Referring to the drawings, there is shown the combined hair styler and hair detangling appliance of the invention designated generally by reference numeral 11. The combination appliance 11 is provided with a housing 12 which is formed by two housing halves which abut along a central plane in a known manner and as is more clearly illustrated in U.S. Pat. No. 3,853,133. One of the housing halves is formed with a series of openings (not shown) which are positioned along the length of an elongated tangential fan rotor or blower 16 to permit the entry of air into the fan rotor 16.

In order to drive the fan rotor 16, there is provided a small permanent magnet d.c. motor 18 which is mounted in a suitable known manner in the forward end of the housing 12. The motor 18 includes an output shaft 19 which is disposed horizontally of the housing 12 and in alignment with the axis of rotation of the rotor 16 and which has a resilient rubber drive bushing 20 received on the outer end thereof. The rotor 16 has end walls 16a, one of which is provided with an opening in which the bushing 20 is received for driving engagement therewith. The other end of the fan rotor 16 is supported by a stub shaft 16b which is received in a suitable bearing assembly 21.

The air drawn in through the air intake openings passes through the fan rotor 16 and is discharged downwardly into an air discharge duct 23. The air discharge duct 23 is in the form of a generally rectangular box having an open top and an open bottom.

A known type of wound wire resistance heating element (not shown) may be provided within the duct 23. Thus, air discharged from the fan rotor 16 may be heated as it passes through the duct 23. The motor 18 may be connected in series with such a heating element and a rectifier across the line voltage with the heating element thereby serving as a dropping resistance.

Adjacent the open bottom of the air discharge duct 23 the housing 12 is formed with an elongated air discharge opening 25 which is characterized by inwardly turned flanges 26 upon which is supported a screen 27. The screen 27 serves to prevent a person's fingers from engaging any heating element disposed in the duct 23 while at the same time providing little obstruction to the air being discharged from the duct 23. If a heating element is provided in the duct 23, a thermostat, calibrated to open the heater circuit when the heat within the duct 23 rises to a point where the plastic parts might be likely to distort or deform, should be connected in circuit therewith. Such a condition could occur if the fan 16 should fail to operate while the heating element is functioning or should there be a blockage of air flow through the duct 23.

Extending lengthwise of the opening 25 and perpendicular to the screen 27 are a pair of counter reciprocating combs 30 which are mounted in closely spaced relation to each other and which are adapted to be reciprocated in an out-of-phase relationship through a relatively short stroke in order to untangle hair, as is described in greater detail in U.S. Pat. No. 3,794,050, dated Feb. 26, 1974. The mechanism for reciprocating the combs 30 includes a motor 31 which is similar to the motor 18 insofar as it is a small permanent magnet motor. Motor 31, which is disposed in the housing 12 adjacent the opposite end of the fan rotor 16 from the motor 18 and which has a drive shaft 32 disposed vertically and normal to the drive shaft 19 of the motor 18, is adapted to be connected through a rectifier to the power supply so that it may be operated completely independently of motor 18. The power requirement for the combs 30, however, is considerably greater than that for the rotor 16 and, accordingly, the motor 31 is substantially more powerful than the motor 18.

The motor 31 is clamped in the housing 12 in a known manner with its vertically disposed drive shaft 32 projecting downwardly through the end wall of a cup-shaped member 33 in which the lower end of the motor 31 is received (FIG. 4), the member 33 being secured to the motor 31 by a fastener 35. A stepped drive member 37 carrying an eccentric drive pin 38 is mounted on the end of the drive shaft of the motor 31 for driving a single yoke rockable drive arrangement for reciprocating the combs 30 in an out-of-phase relationship.

Figure 4:
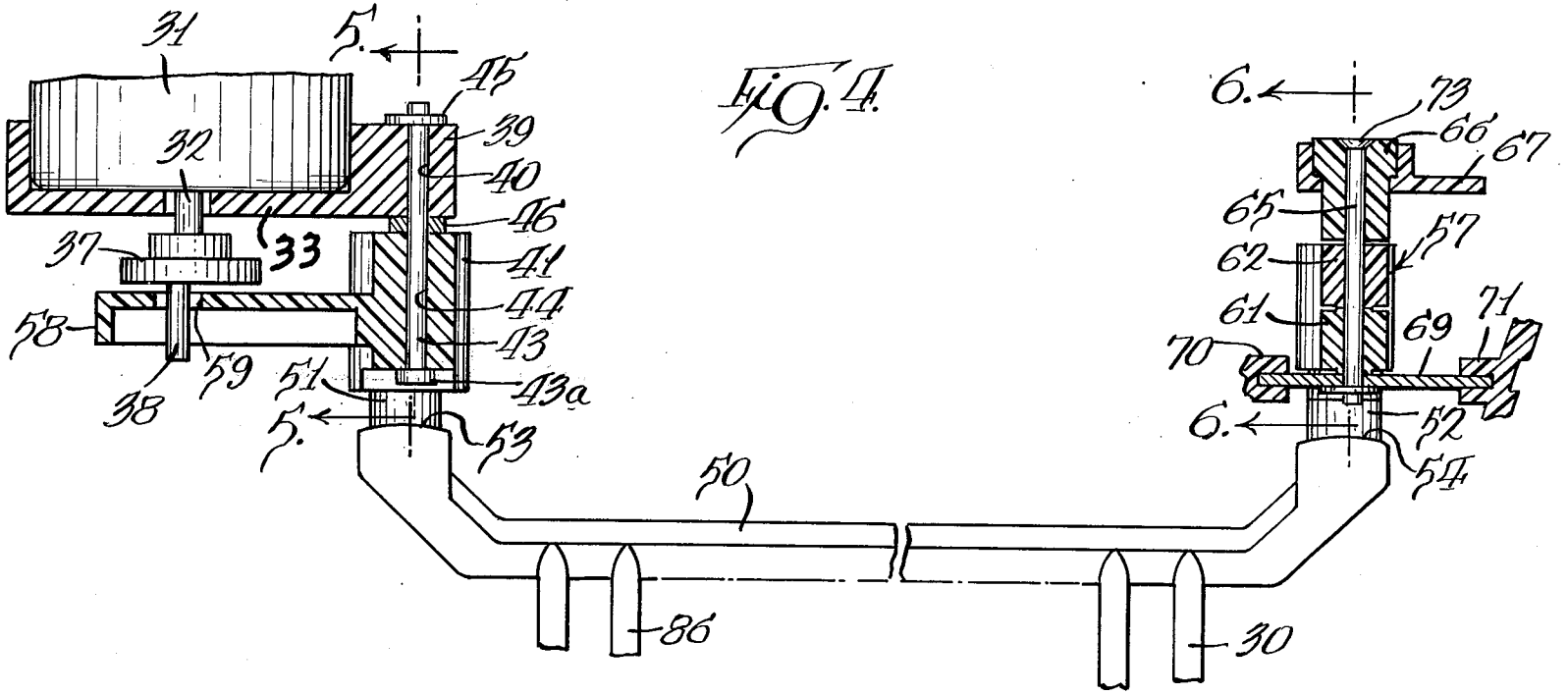
FIG. 4 is a vertical sectional view taken substantially on line 4—4 of FIG. 3 with the housing portions removed for illustration purposes.
Figure 5:
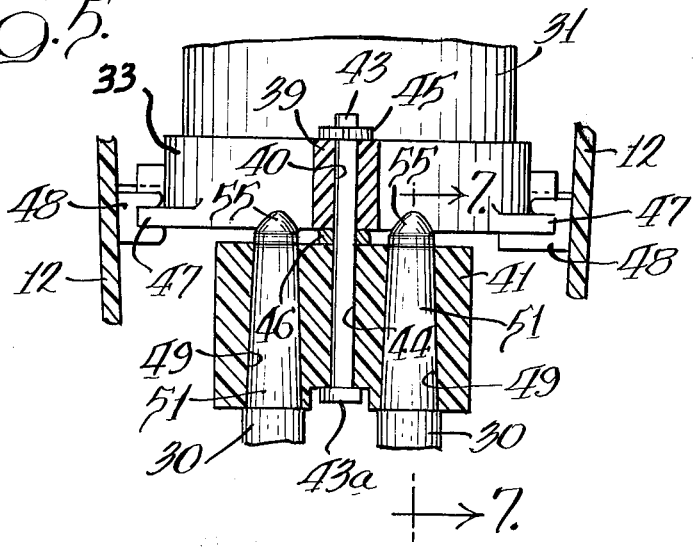
FIG. 5 is a vertical sectional view taken substantially along line 5—5 of FIG. 4.

The cup-shaped member 33 has formed thereon a radially projecting mounting member 39 which extends toward the duct 23 and which has a vertically extending through bore 40 formed therein. A single yoke comb supporting member 41 is rotatably supported at a point midway between its ends from the mounting member 39 by means of a pivot pin 43 which extends upwardly through a verticle bore 44 formed in the comb supporting member 41 (FIGS. 4 and 5). The single yoke comb supporting member 41 is therefore rockable about a vertical axis, the pivot pin 43. The lower end of the pivot pin 43 is provided with a head 43a and a snap ring 45 is provided at the upper end thereof with a bearing spacer 46 being disposed between the mounting member 39 and the comb supporting member 41. As best shown in FIG. 5, the cup-shaped member 33 is provided with side flanges 47 which are received for additional support purposes in slotted guide members 48 integrally formed on the inner surfaces of the two halves of the housing 12.

Figure 3:
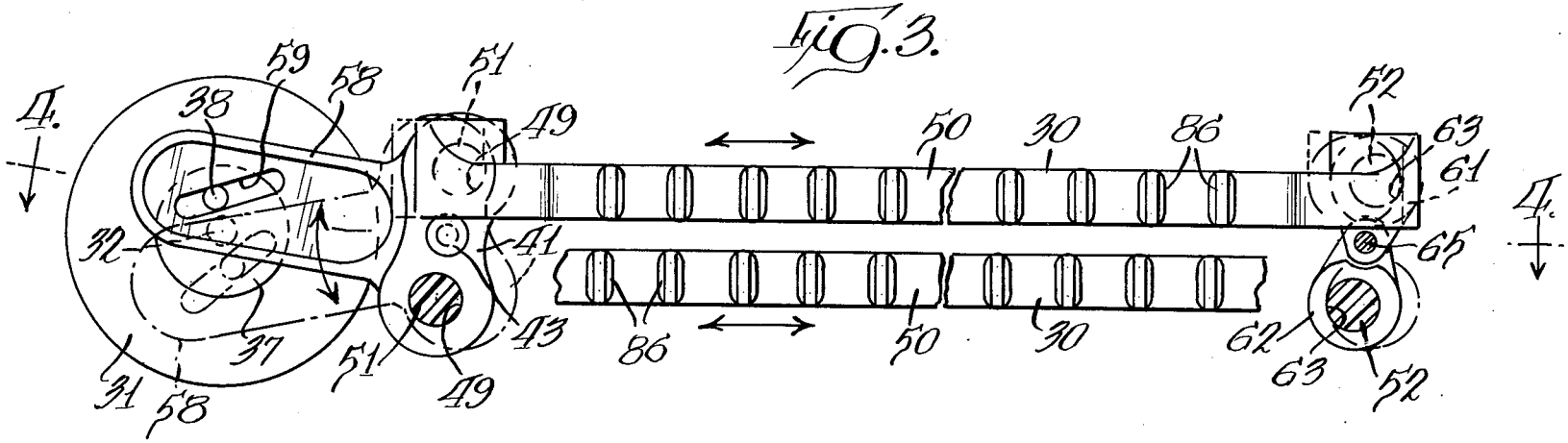
FIG. 3 is an enlarged horizontal sectional view taken substantially along line 5—5 of FIG. 4.
Figure 7:
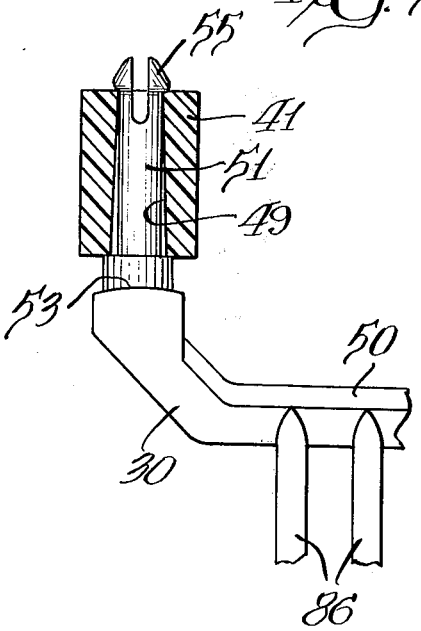
FIG. 7 is a vertical sectional view taken substantially along line 7—7 of FIG. 5.

As shown in FIGS. 3 and 5, a pair of through bores 49 are formed in the comb supporting member 41 on opposite sides of and equidistant from the pivot pin bore 44. Each of the combs 30 is somewhat U-shaped in configuration having a back portion 50 and upwardly extending drive connecting portions 51 and 52 with upwardly facing, slightly curved shoulders 53 and 54 being defined at the base of the connecting portions 51 and 52 for a purpose to be described hereinafter. The connecting portions 51 and 52 are slightly conical with enlarged, vertically slotted upper ends 55 and 56 for resilient retaining engagement in a well known manner in the bores 49 formed in the comb supporting member 41 (FIG. 7) and in similar bores formed in a second comb supporting arrangement 57 which is provided for the forward ends of the combs 30 and which is described hereinafter.

To reciprocally drive the combs 30, the single yoke comb supporting member 41 is provided with an integral rearwardly extending lever arm 58 having a cam slot 59 (FIG. 3) formed therein in which is received the eccentric pin 38 driven by the motor 31. The cam slot 59 is disposed at an angle to the longitudinal axis of the lever arm 58. As the pin 38 is driven in a circle by the motor 31, the single yoke comb supporting member 41 is rocked back and forth about the vertically disposed pivot pin 43, through the engagement of the eccentric pin 38 in the slot 59, to reciprocate the combs 30 in opposite directions in an out-of-phase relationship, the comb supporting arrangement 57 for the forward end of the combs 30 being freely rockable in response to such reciprocal movement, as will be described.

Figure 6:
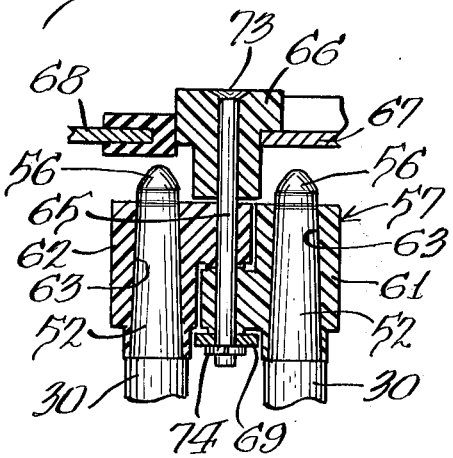
FIG. 6 is a vertical sectional view taken substantially along line 6—6 of FIG. 4.

The comb supporting arrangement 57 for the forward end of the combs 30 is characterized by a pair of L-shaped socket members 61 and 62, one of which, 62, is inverted, wherein the vertical leg portion of each is provided with a through bore 63 for receiving the drive connecting portions 52 of the combs 30 in the manner previously described herein. The horizontal leg portions of the L-shaped socket members 61 and 62 are vertically aligned and a pivot pin 65 extends through aligned bores formed therein (FIG. 6) and through an aligned bore formed in a square-headed supporting member 66 which is non-rotatably received in and trapped between support members 67 and 68 and formed on the inner surfaces of the two halves of the housing 12. A control plate 69 for limiting the rocking movement of the L-shaped socket members 61 and 62 is rotatably mounted on the lower end of the pivot pin 65 and has its ends received in support means 70 and 71 formed on the inner surface of the housing 12. The two socket members 61 and 62 are not rigidly interconnected and thus are rockable relative to one another when not in supporting engagement with the combs 30. The pivot pin 65 is provided with a head 73 at its upper end and with a snap ring 74 at its lower end.

A comb ejector 75 is slidably mounted in tracks formed along the bottom edges of the housing 12 adjacent the air outlet 25 and is characterized by a finger-engageable actuating portion 76, by a pair of side rails 77, by a series of four transverse rails 78, and by inclined cam surfaces 79 formed on two of said transverse rails, rails **78*a* and 78 *b*. The comb ejector 75 is normally biased to a rearward position by a spring 80, in which position the cam surfaces are spaced rearwardly of but longitudinally aligned with the upwardly facing shoulders 53 and 54 of the combs 30. When the comb ejector 75 is slidably advanced forwardly of the housing 12, the cam surfaces 79 engage both the front and rear shoulders 54 and 53, respectively, of both of the combs 30 whereby to cam the combs 30 downwardly to eject same from the comb supporting means 41 and 57.**

Figure 2:
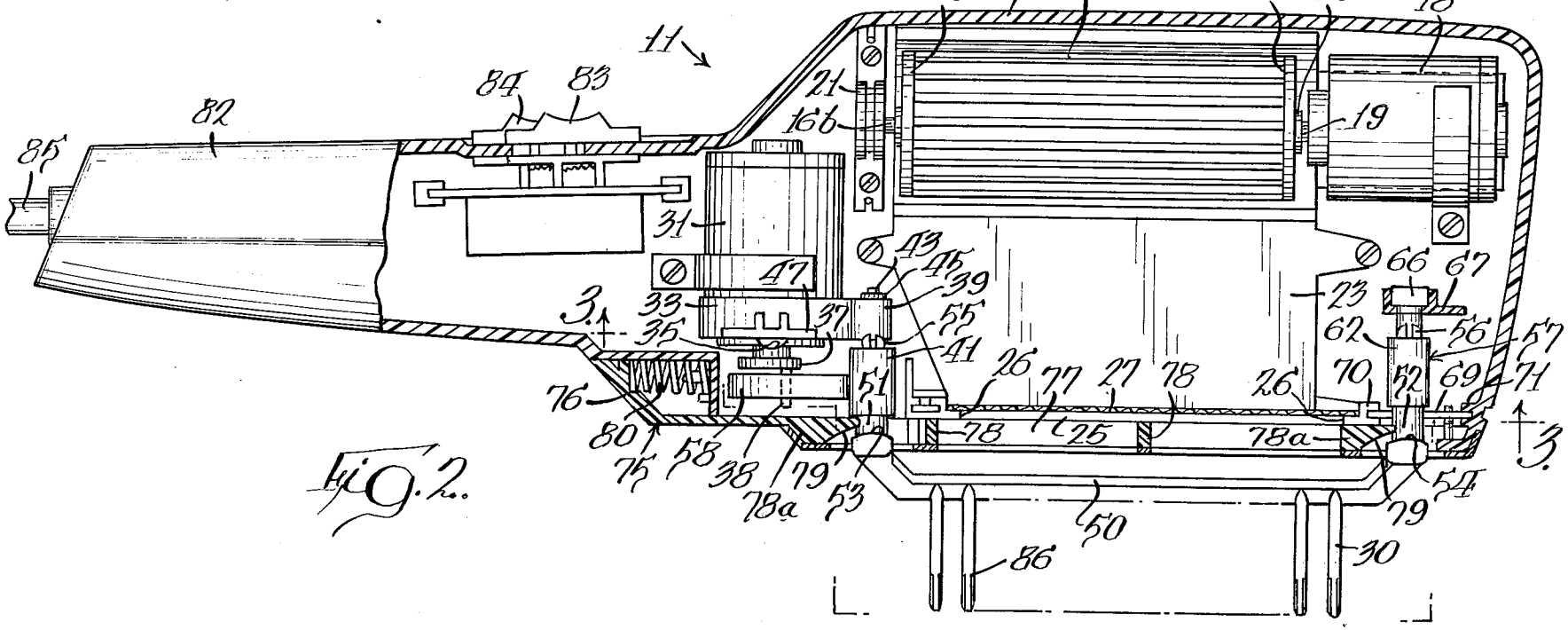
FIG. 2 is an enlarged sectional view taken lengthwise of the housing of the appliance.

As may best be appreciated from considering FIGS. 1 and 2, the combs 30 are situated in such a position that they extend lengthwise of the air outlet opening 25.

The air provided by the fan rotor 16 will therefore be discharged directly on the portion of the hair being vibrated and oscillated by the counter reciprocating combs 30. This rapid and violent action of the combs on the hair separates the strands of hair and makes them very easy to dry at the same time they are being untangled. Accordingly, the drying action produced by the hair styler is expedited considerably by the presence of the counter reciprocating combs. In addition, the detangling action of the combs permits the hair to be separated, untangled and styled much faster than would be possible using a simple comb with a hair dryer.

The loads associated with the detangling combs 30 may be quite large depending on the nature and quality of the hair being untangled. Also the rate with which the user moves the comb through the tangled hair has a significant effect on the load placed on the combs 30. In many instances, however, the rate of reciprocation of the combs 30 is decreased considerably as a consequence of this load. By having a separate motor 31 driving the detangling mechanism, the air circulated by the rotor 16 is in no way affected by the load placed on the motor 31. This is of particular importance if a heating element is provided in the air duct 23.

To provide means for readily manipulating the housing 12, the appliance 11 is provided with an elongated handle 82 which extends laterally from the main portion of the housing which encloses the bulk of the hair styler and detangler mechanism.

Enclosed within the handle 82 is the motor 31 described above as well as a first switch 83 for controlling the operation of the fan motor 18 and a switch 84 which controls separately the operation of the detangler motor 31. The switches 83 and 84 are connected in series circuit with a power cord 85 which enters the end of the handle, as is shown in FIG. 1.

It should be noted that the handle 82 extends from the central portion of the main body portion to provide good balance and easy manipulation of the appliance. This arrangement also permits the motor 31 to be mounted within the handle 82 and coupled by the relatively short lever arm 58 to the reciprocating combs 30.

As is explained more completely in U.S. Pat. No. 3,794,050 referred to previously herein, it is contemplated that the combs 30 would include relatively large teeth 86 which have a center to center spacing of 0.25 inches in a preferred embodiment. In addition, the spacing between the adjacent combs was on the order of 0.065 inches in this preferred embodiment. For the most acceptable performance the combs are reciprocated at a rate of between 6,000 and 9,000 cycles per minute. The stroke length in a preferred form should be on the order of 0.030 to 0.130 inches. If the stroke length is such that, when compared to the tooth spacing, the teeth tend to bypass each other excessively, there is a tendency for the comb to pull the hair and not work as satisfactorily as when shorter stroke lengths are utilized.

While there has been shown and described a particular embodiment of the present invention, it will be apparent to those skilled in the art that various changes and modifications may be made without departing from the invention in its broader aspects, and it is, therefore, contemplated in the appended claims to cover all such changes and modifications as fall within the true spirit and scope of the present invention.

What is claimed as new and desired to be secured by Letters Patent of the United States is:

1. In a combination hair styling and detangling appliance of the type which is characterized by a housing having a handle, air inlet means, and an elongated air discharge outlet, by a tangential fan for directing a flow of air from said inlet means to said discharge outlet and a first motor for driving said fan, by a pair of combs mounted longitudinally of said discharge outlet and in the path of air flow therefrom for reciprocating movement in an out-of-phase relationship to provide a hair detangling function, and by a second motor for reciprocating said combs, the improvement which comprises first comb support and drive means pivotally mounted in said housing at one end of said air discharge outlet for releasably supporting one end of each of said combs, said first comb support and drive means being drivingly connected to said second motor in a manner such that said support and drive means is rockable about a vertical axis to impart out-of-phase reciprocating movement to said combs, second comb support means pivotally mounted in said housing at the other end of said air discharge outlet for releasably supporting the other ends of said combs, and a manually operable comb ejector slidably mounted on said housing adjacent said air discharge outlet for ejecting said combs from said first and second comb support means.

2. The improvement of claim 1 wherein said first comb support and drive means comprises a single yoke member pivotally mounted on a vertically disposed pivot pin in said housing and having an integral lever arm which has a cam slot drivingly engaged by an eccentrically mounted drive pin on said second motor whereby to provide back and forth rocking movement of said yoke member about a vertical axis, and a pair of bore means provided in said yoke member on opposite sides of and equidistant from the axis of rotation of said yoke member for releaseably supporting said one end of each of said combs.

3. The improvement of claim 1 wherein said second comb support means comprises a pair of socket members both of which are pivotally mounted on the same vertically disposed pivot pin in said housing for rocking movement about the same vertical axis, each of said socket members being adapted to releaseably support said other end of each of said combs, said rocking movement of said socket members being imparted thereto solely by said out-of-phase reciprocating movement of said combs.

4. The improvement of claim 1 wherein said combs are provided with a series of upwardly facing shoulders and wherein said slidably mounted comb ejector is provided with a series of inclined cam surfaces engageable with said upwardly facing shoulders upon manual operation of said comb ejector to facilitate removal of said combs from said first and second comb support means.

5. A hair styling and detangling appliance comprising a housing enclosing a first motor and an elongated tangential fan drivingly interconnected and positioned along one wall of said housing with said first motor and fan having their axes aligned and disposed horizontally and longitudinally of said housing, air intake means in said housing adjacent to said fan, air discharge means in said housing characterized by an elongated air discharge slot substantially coextensive with said fan and interconnected with said fan by an air duct, comb support means rockable about vertical axes and disposed at opposite ends of said air discharge slot for mounting a pair of spaced parallel comb members, a second motor enclosed in said housing with its drive shaft disposed vertically and drivingly interconnected to said combs through a single lever arm connected to said comb support means at one end of said discharge slot whereby to reciprocate said combs in opposite directions, said combs being positioned to extend lengthwise in front of said air discharge slot outside of said housing with drive connecting portions extending into said housing at opposite ends of said air discharge slot, and a manually slidable comb ejector having cam means formed thereon for ejecting said combs from said comb support means.

6. In a combination hair styler and detangling appliance of the type which is characterized by a housing having a handle, air inlet means, and an elongated air discharge outlet, by a tangential fan for directing a flow of air from said inlet means to said discharge outlet and a first motor for driving said fan, by a pair of combs mounted longitudinally of said discharge outlet and in the path of air flow therefrom for reciprocating movement in an out-of-phase relationship to provide a hair detangling function, said combs each being characterized at opposite ends thereof by a pair of drive connecting portions which extend in a direction directly opposite to that of the comb teeth, and by a second motor for reciprocating said combs, an improved comb supporting and driving means comprising a single yoke member pivotally mounted in said housing adjacent the end of said discharge outlet nearest said handle for rocking movement about a vertical axis, means mounting said second motor in the handle portion of said housing with its drive shaft disposed vertically, drive means interconnecting said second motor and said single yoke member for rocking same about said vertical axis, bore means formed in said yoke member on opposite sides of the pivot axis thereof for removably receiving one of said drive connecting portions of each of said combs, and support means for the other drive connecting portions of each of said combs pivotably mounted in said housing adjacent the opposite end of said discharge outlet for rocking movement about a vertical axis.

7. The improved comb supporting and driving means of claim 6 wherein the drive shaft of said second motor is provided with a vertically disposed eccentrically mounted drive pin which is engageable in a cam slot provided in a lever arm of said yoke member whereby said yoke member is rocked back and forth about said vertical axis during operation of said second motor to provide said out-of-phase reciprocating movement of said combs.

8. The improved comb supporting and driving means of claim 6 wherein said support means for said other drive connecting portions of each of said combs comprises a pair of socket members each of which is adapted to removably receive one of said other drive connecting portions, and wherein both of said socket members are rotatably supported on a single vertically disposed pivot pin supported in said housing, whereby said pair of socket members are rockable about the same verticle axis in response to said out-of-phase reciprocating movement of said combs.

9. The improved comb supporting and driving means of claim 6 wherein said drive connecting portions of said combs are provided with upwardly facing shoulders, and wherein a manually operable comb ejector is slidably mounted on said housing adjacent said air discharge outlet, said comb ejector having inclined cam surfaces formed thereon for camming engagement with said upwardly facing shoulders when said comb ejector is manually operated whereby to facilitate removal of said combs from the appliance.

10. A combination hair styling and detangling appliance comprising a housing having air inlet means and an elongated air discharge outlet, a motor driven tangential fan for directing a flow of air from said inlet means to said discharge outlet, a pair of combs mounted longitudinally of said discharge outlet and in the path of air flow therefrom for reciprocating movement in an out-of-phase relationship to provide a hair detangling function, first comb support and drive means for one end of said pair of combs in the form of a yoke member pivotally mounted in said housing adjacent one end of said discharge outlet for rocking movement about a vertical axis, motor driven means for rocking said yoke member about said vertical axis, second comb support means for the opposite end of said pair of combs pivotally mounted in said housing adjacent the opposite end of said discharge outlet for rocking movement about a vertical axis, means for releaseably mounting said pair of combs in said first comb support and drive means and in said second comb support means, and manually operable comb ejector means for removing said pair of combs from said first comb support and drive means and from said second comb support means.

* * * * *